US006227152B1

(12) United States Patent
Freller

(10) Patent No.: US 6,227,152 B1
(45) Date of Patent: May 8, 2001

(54) INTERNAL COMBUSTION ENGINE

(76) Inventor: Walter Freller, Innerschwand 226, A-5310 Mondsee (AT)

( * ) Notice: Subject to any disclaimer, the term of this patent is extended or adjusted under 35 U.S.C. 154(b) by 0 days.

(21) Appl. No.: 09/319,551

(22) PCT Filed: Dec. 10, 1997

(86) PCT No.: PCT/AT97/00272

§ 371 Date: Jun. 8, 1999

§ 102(e) Date: Jun. 8, 1999

(87) PCT Pub. No.: WO98/26157

PCT Pub. Date: Jun. 18, 1998

(30) Foreign Application Priority Data

Dec. 11, 1996 (AT) ..... 2156/96

(51) Int. Cl.[7] ..... F02B 53/00

(52) U.S. Cl. ..... 123/18 R; 74/25; 74/50; 123/507; 123/549; 417/481; 417/482; 92/22; 91/339; 91/177

(58) Field of Search ..... 123/18 R, 507, 123/549; 60/608; 74/25, 50; 417/481, 482; 92/22; 91/339, 177

(56) References Cited

U.S. PATENT DOCUMENTS

| | | | | |
|---|---|---|---|---|
| 837,507 | * | 12/1906 | Rapp | 123/18 R |
| 988,704 | * | 4/1911 | Goodrich | 123/18 R |
| 3,408,991 | * | 11/1968 | Davis | 123/18 R |
| 3,834,242 | * | 9/1974 | Seybold | 74/25 |
| 4,272,229 | | 6/1981 | Pape . | |
| 4,756,377 | * | 7/1988 | Kawamura et al. | 60/608 |
| 4,884,532 | | 12/1989 | Tan . | |
| 5,168,706 | * | 12/1992 | Kawamura | 60/608 |
| 5,297,530 | * | 3/1994 | Kaneko et al. | 123/549 |
| 5,924,411 | * | 7/1999 | Guettle et al. | 123/259 |

FOREIGN PATENT DOCUMENTS

| | | |
|---|---|---|
| 54 778 | 12/1890 | (DE) . |
| 16 01 818 | 1/1971 | (DE) . |
| 26 39 530 | 3/1978 | (DE) . |
| 447 632 | 1/1913 | (FR) . |
| 481162 | 11/1916 | (FR) . |
| 577 656 | 6/1946 | (GB) . |

* cited by examiner

*Primary Examiner*—Thomas Denion
*Assistant Examiner*—Thai-Ba Trieu
(74) *Attorney, Agent, or Firm*—Collard & Roe, PC

(57) ABSTRACT

There is described an internal combustion engine comprising at least one cylinder and a crankcase (5), which together with the cylinder forms a common, circular cylindrical tubular body (1), and comprising an oscillating piston (7) rotatably mounted about the cylinder axis and separating a cylinder space (4) defined by radial walls (3) from the crankcase (5), which oscillating piston is in drive connection with a crankshaft (16) parallel to the cylinder axis via a connecting link guide (17) for at least one crank pin (18) of the crankshaft (16), which is provided on the crankcase side of the oscillating piston (7). To create advantageous constructional conditions, it is proposed that the crank pin (18) is supported on the connecting link guide (17) via a roller (19), and that the tubular body (1) forming the cylinder and the crankcase (5) is thermally insulated to the outside.

7 Claims, 2 Drawing Sheets

INTERNAL COMBUSTION ENGINE

Figure 2:
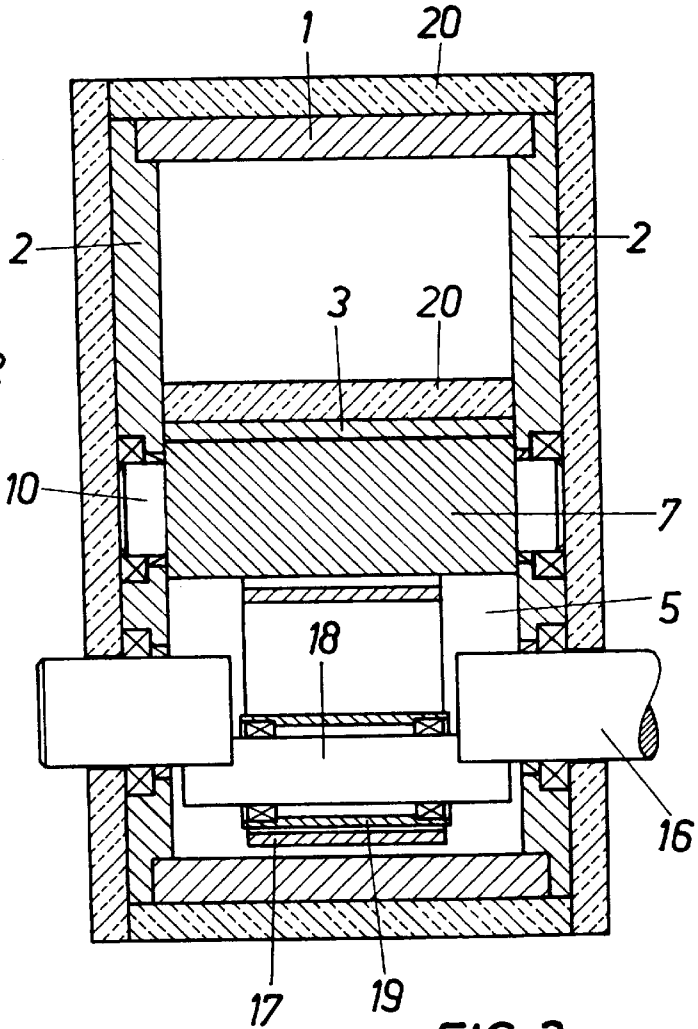

This invention relates to an internal combustion engine comprising at least one cylinder and a crankcase which together with the cylinder forms a common, circular cylindrical tubular body, and comprising an oscillating piston rotatably mounted about the cylinder axis and separating a cylinder space defined by radial walls from the crankcase, which oscillating piston is in drive connection with a crankshaft parallel to the cylinder axis via a connecting link guide provided on the crankcase side of the oscillating piston for at least one crank pin of the crank shaft.

To produce a drive connection between the oscillating piston and the crankshaft in internal combustion engines with an oscillating piston performing a reciprocating rotary movement, and with a crankshaft parallel to the axis of rotation of the oscillating piston, it is known (U.S. Pat. No. 4,272,229) to pivotally mount on the oscillating piston a connecting rod, which is supported on the crank pin of the crankshaft, at a distance from the axis of rotation of the oscillating piston. This pivotal mounting of the connecting rod may, however, produce constraining forces, which should not only be considered when mounting the oscillating piston, but possibly also influence the sealing conditions for the oscillating piston. In this connection it should be noted that the efficient sealing of the cylinder space is very susceptible to deformations as a result of thermal or mechanical loads, which affect the sealing gap between the generally plate-shaped oscillating piston and the cylinder.

As regards such internal combustion engines it is in addition known (FR-PS 447 632) to mount on the crank pin a slide ring, which is held in a radial slideway connected with the oscillating piston. The crankcase is formed in a simple way by a circular cylindrical tubular body, which is enclosed by a cooling jacket. The oscillating piston substantially has the shape of a hollow semicylinder, whose outside diameter is adapted to the inside diameter of the tubular body, and which is stiffened by the radial slideway for the slide ring. This construction not only makes a crankcase scavenging impossible, but due to the slide ring guidance is also susceptible to wear. There is also a non-uniform thermal load of the tubular body, which as a result of the cooling-related, non-uniform distribution of heat around the periphery is subjected to different thermal expansions, so that there are difficulties as regards the sealing of the piston, which in turn restricts the possible compression of the air-fuel mixture.

It is therefore the object underlying the invention to design an internal combustion engine as described above with simple constructive means such that on the one hand advantageous power transmission conditions between the oscillating piston and the crankshaft and on the other hand favorable sealing conditions for the cylinder space can be ensured.

This object is solved by the invention in that the crank pin is supported on the connecting link guide via a roller, and that the tubular body forming the cylinder and the crankcase is thermally insulated to the outside.

By means of the roller on the crank pin, which cooperates with the connecting link guide, there is achieved a simple low-vibration power transmission between the oscillating piston and the crankshaft, which due to the substantial independence of manufacturing tolerances is free from constraints, where an appropriate choice of the lever ratios ensures an advantageous torque introduction. To take into account the thermal expansions inevitable in the operation of such an internal combustion engine, the entire tubular body, i.e. both the cylinder and the crankcase, is thermally insulated to the outside, so that a uniform thermal expansion of the tubular body including the oscillating piston is possible. By means of this measure a sufficiently narrow sealing gap between piston and cylinder can be ensured even under high thermal loads, to ensure a good efficiency without use of a sealing susceptible to wear between the oscillating piston and the cylinder walls. In this connection it should also be noted that the roller of the crank pin cooperating with the connecting link guide makes a heat dissipation to the crankshaft difficult as compared to a slide ring or a connecting rod, because between the roller and the connecting link guide there is substantially produced only a line contact.

Since due to the reciprocating oscillating piston oppositely directed forces must be transmitted via the connecting link guide, the connecting link guide may consist of an oblong hole accommodating the roller of the crank pin. In an oscillating piston constituting a double piston, the two piston halves extending diametrically from the common axis of rotation perform torsional vibrations offset against each other by 180° with respect to a crankshaft. This fact can be utilized to alternately use the two piston halves for power transmission. For this purpose, there may be provided two parallel crankshafts each associated to one piston half and in drive connection with each other, which each cooperate with a connecting link guide on the associated piston half. The connecting link guides, which in such a case merely represent a straight slideway for the associated rollers on the crank pins, each act on the associated crankshafts during the working stroke, but not during the return stroke of the piston halves, which creates simple constructional conditions. Due to the drive connection of the two alternately driven crankshafts there is nevertheless obtained a continuous crankshaft drive. In the case of an elastic bias of this drive connection between the two crankshafts, for instance via a toothed belt drive, a clearance-free connecting link guide can be achieved for the rollers of the crankshafts. The rollers associated to the two connecting link guides may, however, also be associated to a common crankshaft.

To ensure that in the operation of an internal combustion engine a separate drive for the fuel injection pump with a corresponding lift-dependent control can be omitted, there may be provided a fuel injection pump to be driven by the oscillating piston itself via a tappet protruding into the cylinder space. With the tappet actuation by the oscillating piston the fuel injection pump is actuated at the stroke frequency of the oscillating piston, where advantageously diaphragm pumps can be used because of the simple sealing. When for the actuation of the fuel injection pump the tappet carries at its end protruding into the cylinder space a piston cooperating with a blind hole recess in the oscillating piston, the tappet actuation at least at higher stroke frequencies is effected via a gas cushion, which is formed when the piston engages in the blind hole recess.

To be able to utilize the high exhaust gas temperature of the internal combustion engine for an improved ignition of the respective fresh gas charge, the cylinder space may have a possibly heatable heat storage grid in the vicinity of the radial walls, which absorbs part of the exhaust gas heat and dissipates the same to the fresh gas charge. To obtain favorable ignition conditions in the case of a cold start, the heat storage grid may in addition be heated.

Figure 1:
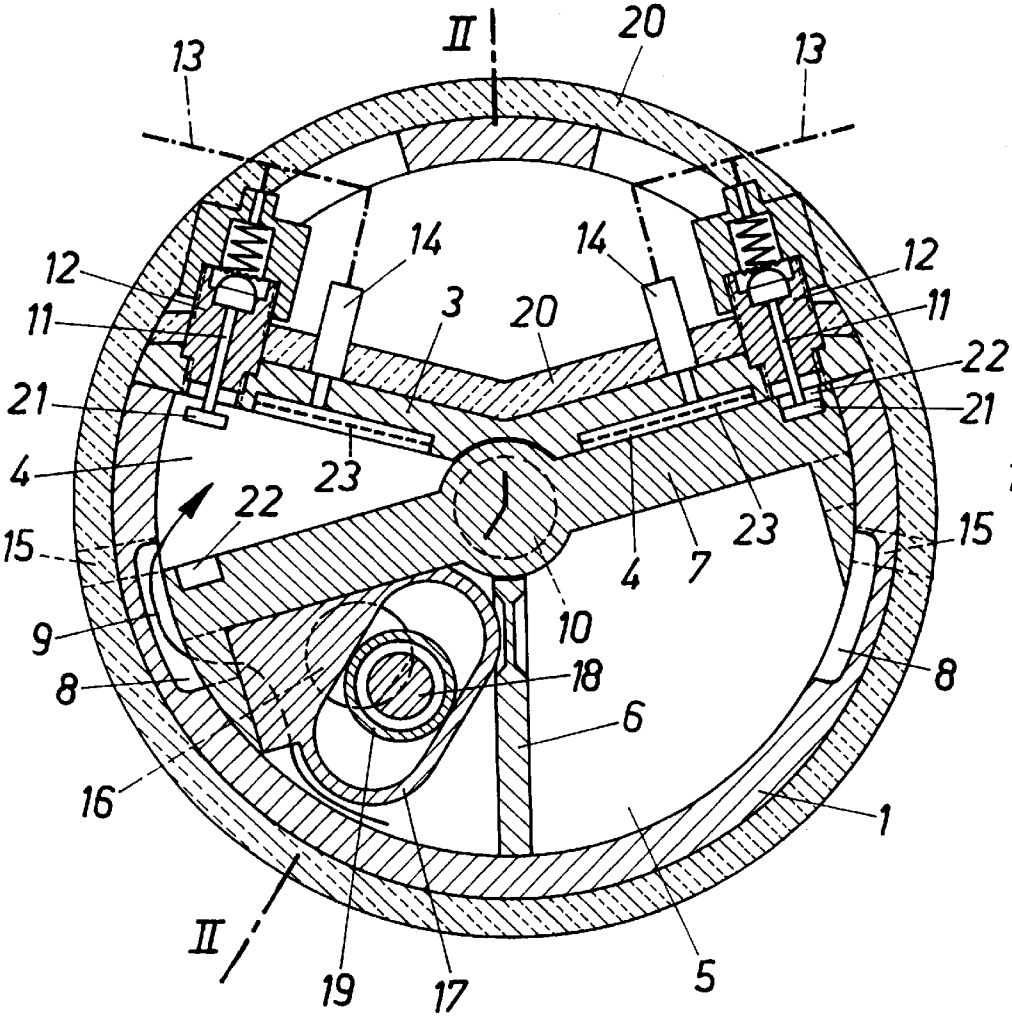
Figure 3:
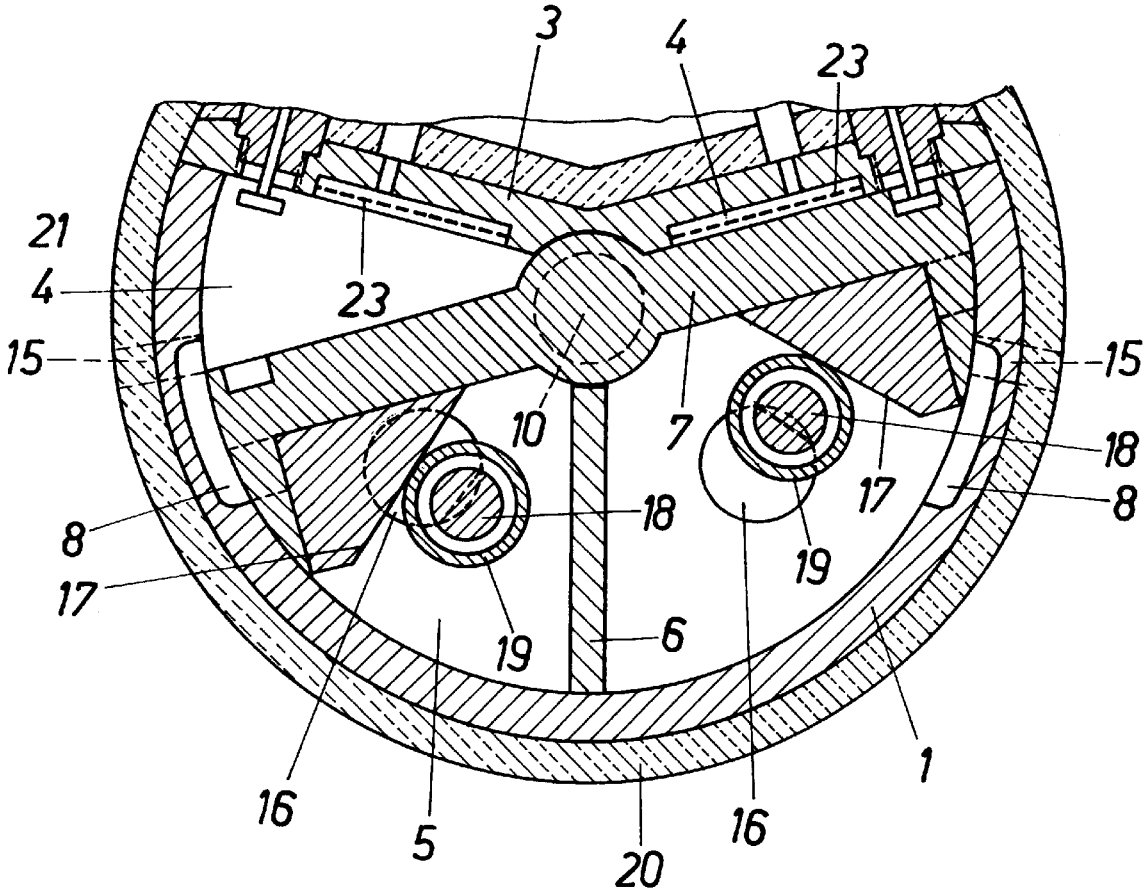

In the drawing, the subject-matter of the invention is represented by way of example, wherein:

FIG. 1 shows an inventive internal combustion engine in a schematic cross-section, FIG. 2 shows this internal combustion engine in a section along line II—II of FIG. 1 with a crankshaft swivelled into the drawing plane, and FIG. 3 shows an embodiment of an inventive internal combustion engine modified with respect to the internal combustion engine shown in FIGS. 1 and 2, partly in a cross-section corresponding to FIG. 1.

The internal combustion engine in accordance with the embodiment shown in FIGS. 1 and 2 has a circular cylindrical tubular body 1 with end walls 2 as housing, which on the one hand forms cylinder spaces 4 defined by radial walls 3 and on the other hand a crankcase 5. This crankcase 5 is divided by a radial partition 6 into two chambers which are each separated from the associated cylinder spaces 4 by one half of an oscillating piston 7 constituting a double piston. The chambers of the crankcase 5 are conventionally connected with the associated cylinder spaces 4 by transfer passages 8, so that for instance fresh air sucked into the respective chamber of the crankcase 5 by a usual intake valve not represented can get into the cylinder space 4 corresponding to the flow arrow 9, in order to be compressed during the subsequent rotary movement of the oscillating piston 7 about its axis of rotation 10 coaxial to the axis of the tubular body 1. In the vicinity of the return position of the compression stroke the oscillating piston 7 acts on a tappet 11 of a fuel injection pump 12, which constitutes a spring-loaded diaphragm pump and injects the fuel previously sucked in from the fuel supply line 13 provided with a return control valve into the cylinder space 4 via an injection nozzle 14. The ignition of the injected fuel causes a working stroke by a corresponding piston actuation, where the oscillating piston 7 clears an exhaust passage 15 before the return position of the working stroke, through which exhaust passage the exhaust gases flow out of the cylinder space 4, which is then again supplied with fresh air via the transfer passage 8. Since the oscillating piston 7 constitutes a double piston, the one piston half performs a working stroke during the compression stroke of the other piston half and subsequently a compression stroke during the working stroke of the other piston half.

To be able to transmit the reciprocating rotary movement of the oscillating piston 7 to a crankshaft 16, which like the oscillating piston 7 is supported in the end walls 2 of the housing, the oscillating piston 7 has a connecting link guide 17 in the form of an oblong hole on the side of the crankcase, which oblong hole is aligned substantially radially with respect to the axis of rotation 10 of the oscillating piston 7. This oblong hole of the connecting link guide 17 accommodates a roller 19 supported on a crank pin 18 of the crankshaft 16. The reciprocating rotary movement of the oscillating piston 7 is thus converted into a rotary movement of the same direction performed by the crankshaft 16 via the connecting link guide 17, where there is obtained a low-vibration drive connection free from constraints since the roller 19 rolls along the connecting link guide 17, which drive connection on the one hand has an advantageous influence on the load conditions and on the other hand represents a prerequisite for a narrow sealing gap between the oscillating piston 7 and in particular the tubular body 1. A further prerequisite for such narrow sealing gap not represented in the drawing, which makes separate sealings superfluous, consists in a uniform thermal load of the entire housing. This prerequisite can only be satisfied in that the tubular body 1 with the end walls 2 has a thermal insulation 20 to the outside, so that the same conditions of thermal expansion are obtained for the entire housing.

As can be taken from FIG. 1, the tappet 11 protruding into the cylinder space 4 is provided with a piston 21 for actuating the fuel injection pump 12, which piston cooperates with a blind hole recess 22 in the oscillating piston 7, so that at least at higher stroke frequencies the tappet 11 is actuated via a gas cushion, which is formed when the piston 21 engages in the recess 22.

To promote the ignition of the fuel injected in the cylinder space 4, a heat storage grid 23 may be provided in the vicinity of the radial cylinder walls 3, which is heated by the hot exhaust gases and dissipates part of the heat to the fresh air, which due to the entire thermal insulation is preheated via the uncooled crankcase.

The embodiment shown in FIG. 3 differs from that shown in FIGS. 1 and 2 merely by the kind of drive connection between the oscillating piston 7 and the crankshaft 16. In contrast to the embodiment shown in FIGS. 1 and 2, two parallel crankshafts 16 each for one half of the oscillating piston constituting a double piston are provided in the internal combustion engine shown in FIG. 3, where the two crankshafts 16 each cooperate with a connecting link guide 17 associated to the piston halves via a roller 19 on the crank pin 18 The arrangement has been made such that the connecting link guides 17 merely constituting a straight slideway for the rollers 19 can exert compressive forces on the crank pin 18 only during the working stroke, so that the two crankshafts 16 must be in drive connection with each other to ensure a continuous crankshaft drive. In the case of an elastic bias of this drive connection, for instance via a toothed belt drive, guide and return clearances can be compensated. As can be taken directly from FIG. 3, particularly simple constructional conditions are obtained by two crankshafts 16 alternately actuated by the oscillating piston 7 and in drive connection with each other.

The invention is of course not restricted to the illustrated embodiments. The fuel injection pump might for instance be connected with an external drive, where the advantageous possibility is obtained to provide the fuel injection pump at the periphery of the tubular body over which moves the oscillating piston, in order to avoid a thermal overload of the fuel injection pump by covering the fuel injection pump by the oscillating piston 7 after the fuel injection.

What is claimed is:

1. An internal combustion engine comprising (a) a circular cylindrical tubular body having an axis and being thermally insulated to the outside, the circular cylindrical tubular body forming
  (1) at least one cylinder and
  (2) a crankcase, and
  (3) radial walls defining a cylinder space, (b) an oscillating piston mounted in the circular cylindrical tubular body for rotation about the axis and separating the cylinder space from the crankcase, (c) a crankshaft extending parallel to the axis and having a crank pin, and (d) a drive connection between the oscillating piston and the crankshaft, the drive connection including
  (1) a connecting link guide for the crank pin on the crankcase side of the oscillating piston, and
  (2) a roller supporting the crank pin on the connecting link guide.

2. The internal combusion engine of claim 1, wherein the connecting link guide is an oblong hole accommodating the roller.

3. The internal combustion engine of claim 1, wherein the oscillating piston constitutes a double piston having two piston halves, two of said crankshafts are arranged parallel to each other and in drive connection with each other, a respective one of the crankshafts being associated with a respective one of the piston halves, and each crankshaft cooperating with a connecting link guide on the associated piston half.

4. The internal combustion engine of claim 1, further comprising a fuel injection pump driven by the oscillating piston by a tappet having an end protruding into the cylinder space.

5. The internal combustion engine of claim 4, wherein the tapper end carries a piston cooperating with a blind hole recess in the oscillating piston.

6. The internal combustion engine of claim 1, further comprising a heat storage grid in the cylinder space adjacent the radial walls.

7. The internal combustion engine of claim 6, wherein the heat storage grid is heatable.

* * * * *